United States Patent [19]

Germain

[11] Patent Number: 4,473,911

[45] Date of Patent: Oct. 2, 1984

[54] BATHTUB RIM WATER DAM

[76] Inventor: Sylvia A. Germain, R.R. #5, Belleville, Ontario, Canada, K8N 4Z5

[21] Appl. No.: 492,506

[22] Filed: May 9, 1983

[30] Foreign Application Priority Data

Dec. 14, 1982 [CA] Canada ..... 417610

[51] Int. Cl.[3] ..... A47K 3/22

[52] U.S. Cl. ..... 4/609; 4/559; 4/596; 4/605; 4/613

[58] Field of Search ..... 4/559, 538, 608, 609, 4/558, 595, 596, 605, 607, 612, 613, 546

[56] References Cited

U.S. PATENT DOCUMENTS

| | | | |
|---|---|---|---|
| 1,807,107 | 5/1931 | Sternbergh | 4/608 |
| 2,102,082 | 12/1937 | Lucke | 4/595 |
| 2,427,375 | 9/1947 | Walker et al. | 4/584 |
| 3,052,248 | 9/1962 | Reuter | 134/200 X |
| 3,639,919 | 2/1972 | White | 4/558 |
| 3,737,921 | 6/1973 | Baumrind | 4/609 |
| 3,808,610 | 5/1974 | Mortensen | 4/558 |
| 3,895,399 | 7/1975 | Giarrante | 4/558 |
| 4,025,970 | 3/1977 | Robust | 4/559 |
| 4,077,072 | 3/1978 | Dazura | 4/558 |

FOREIGN PATENT DOCUMENTS

| | | |
|---|---|---|
| 903954 | 7/1972 | Canada . |
| 1106553 | 8/1981 | Canada . |

*Primary Examiner*—Henry K. Artis

*Attorney, Agent, or Firm*—Cushman, Darby & Cushman

[57] ABSTRACT

An improvement in a shower stall having a curtain extending between walls forming the stall is provided, said stall having a receptacle in which a person may stand while showering, said receptacle having a rim capable of allowing water to run along its top surface between the walls and the curtain out of the shower stall, the improvement being a water dam comprising a strip adapted to be affixed to the top surface of the rim of the receptacle in abutment with a wall of the stall near an end of the curtain and further adapted to traverse the top surface of the rim and continue a short distance down into the receptacle.

4 Claims, 3 Drawing Figures

BATHTUB RIM WATER DAM

FIELD OF INVENTION

This invention relates to a shower-bath fixture and more particularly, to a water dam affixed to the upper rim of the bathtub.

BACKGROUND OF THE INVENTION

In conventional shower-bath arrangements, a bathtub is usually located in an alcove area or stall having a front, a back and a side wall. The shower nozzle is fixed overhead and centrally on the front wall. A shower curtain is provided which slides along a rod and is adapted to close the stall opening when the shower is in use. However, it has been a long standing problem that a shower curtain does not prevent the escape of all water from the shower.

In the prior art, a number of patents have issued with respect to inventions attempting to solve the problem of water escaping around the sides of a shower curtain. For example Canadian Pat. No. 903,954 which issued July 4, 1972 to Ronald J. Sparling discloses an "L" shaped angle iron which may be affixed at the corner of the tub and the front and back wall to deflect water back into the bathtub.

U.S. Pat. No. 3,737,921 which issued June 12, 1973 to Stephen J. Baumrind discloses a permanent or mobile splash guard which may be installed on the corner of the bathtub. Canadian Pat. No. 1,106,553 which issued Aug. 11, 1981 to Carson W. Masters, discloses a reflector plate which is located on the wall above the corner of the bathtub and is adapted to deflect the water from the shower back to the bathtub.

U.S. Pat. No. 1,807,107 issued May 26, 1931 to L. M. Sternbergh discloses another type of splash guard extending along the wall above the corner of the bathtub.

U.S. Pat. No. 3,104,014 which issued Sept. 17, 1963 to R. E. Piette; U.S. Pat. No. 3,808,610 which issued May 7, 1974 to Mortensen; U.S. Pat. No. 2,303,502 which issued Dec. 1, 1942 to B. Rous; Canadian Pat. No. 1038557 which issued Sept. 19, 1078 to Waldo Dezura and U.S. Pat. No. 3,895,399 which issued July 22, 1975 to Gary C. Giarrante all disclose means of controlling the shower curtain to seal off the stall in a manner to prevent the escape of water while a person is taking a shower.

The damage caused by water escaping from a bathtub when a person takes a shower is significant. The continued wetting of the floor and wallboard around a bathtub can lead to rotting of the floorboards and the surrounding walls, to discolouration of the floor and wall surfaces, as well as similar damage to the structural and surface components of rooms below the bathroom. Moreover, immediately after the shower, wetting of the bathroom floor may result in a slippery surface which can lead to accidents as the person leaves the shower stall.

It has been observed by the inventor that the primary cause for water escaping from the bathtub during a shower is not splashing directly onto the floor through the openings between the shower curtain and the walls, but instead is caused frequently by water running along the bathtub rim and over the edge of the tub. It has been observed that the water splashing inside the shower stall usually hits the front, back and side walls and then runs down to the rim of the bathtub. In the usual case, the bathtub rim will be flat and the water will collect at the foot of the walls and run around the bathtub rim and past the shower curtain, which is usually tucked inside the bathtub rim. When the water reaches the rim outside the shower curtain, there is no wall to contain it and the water runs down the side of the tub onto the floor.

While some of the prior art patents listed above have disclosed means for preventing water from splashing between the shower curtain and the wall, it is felt that the means suggested do not overcome necessarily the problem described above. Most of the means disclosed in the prior art are directed to the prevention of splashing rather than the prevention of runoff along the bathtub rim. Where the deflectors in the prior art meet the bathtub rim, they are usually located centrally along the top flat surface of the rim. This location generally permits the water to run along the bathtub rim adjacent to the inside surface of the deflector and then to escape over the side of the bathtub after it passes the deflector.

Moreover, the prior art deflector plates may well constitute a safety hazard to a person getting in and out of the bathtub. For example, the shower bath curtain guard disclosed in Canadian Pat. No. 903,954 to Ronald J. Sparling could present a dangerous obstacle to persons, especially children, getting in and out of the bathtub. It would also deal a severe blow to someone who fell against it. Much of the prior art suffers similar deficiencies.

OBJECTS

It is an object of this invention to provide a safe, simple and cost effective means of overcoming the problem of water escaping along the rim of the bathtub during the taking of a shower.

It is a further object of this invention to provide a means which will effectively prevent the escape of water along the bathtub rim which may be easily installed at low cost by a householder.

It is an object of this invention to provide a means for diverting water flowing about the rim of the bathtub back into the bathtub without presenting safety hazards to persons entering or leaving the bathtub.

The present invention is, in a shower stall having a curtain extending between walls forming the stall, said stall having a receptacle in which a person may stand while showering, said receptacle having a rim capable of allowing water to run along its top surface between the walls and the curtain out of the shower stall, the improvement comprising a water dam being a strip adapted to be affixed to the top surface of the rim of the receptacle in abutment with a wall of the stall near an end of the curtain and being adapted to traverse the top surface of the rim and continue a short distance down into the receptacle.

It is preferred that the strip be fabricated of a soft pliable material like plastic. The preferred means of attachment to the bathtub is adhesion by means of a water resistant glue. It has been found that when heated at 150° C. (300° F.) for 2–3 minutes, plastic trim for automobiles is ideally suited to this purpose if it is cut to appropriate lengths. The ends should be cut on a slant to fit tightly against the wall.

It will be appreciated by those skilled in the art that the receptacle may simply be some kind of basin in which a person may stand while taking a shower, or may be a bathtub.

Similarly it will be understood that somtimes shower stalls are comprised of two walls with a shower curtain extending around the other two sides of the receptacle. In other cases, an perhaps more commonly, the shower stall will be made up of a front, a side and a back wall with the shower curtain extending between the front and back wall. Whatever the configuration may be, in any particular case, the water dam of the present invention is installed across the rim of the receptacle near the wall at a position where the shower curtain would meet it when closed across the stall.

It will be appreciated that the water dam of this nature may be affixed to the rim at either the front or back walls of a shower stall or both as may be considered desirable in any particular case.

DESCRIPTION OF THE FIGURES

In the Figures which illustrate a preferred embodiment of this invention:

FIG. 1 illustrates a shower-bath arrangement (10) having a conventionally constructed bathtub (12) located in an alcove or stall (11) having vertical end walls (14) and (16) and a side wall (18). A shower nozzle (19) projects over the bathtub (12) from end wall (16).

Figure 1:
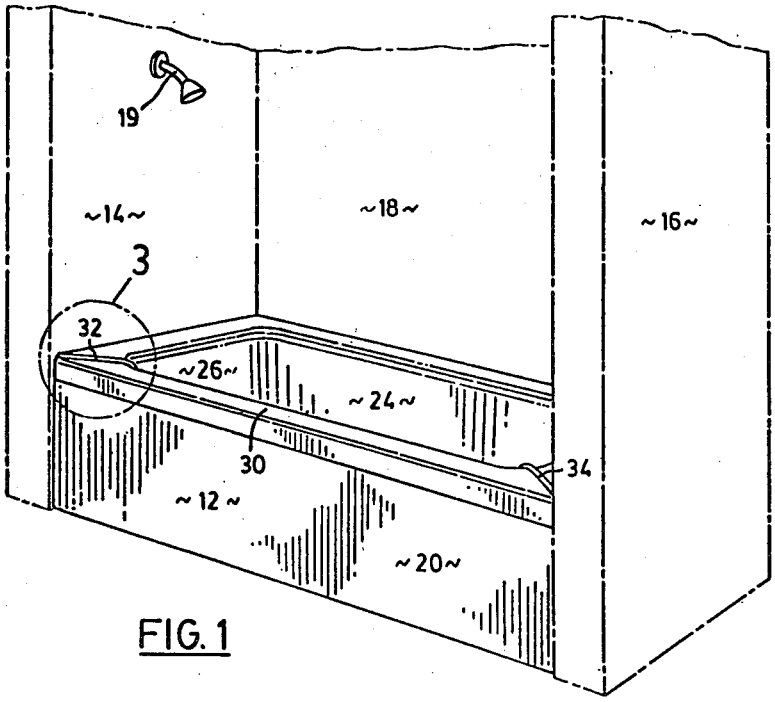
FIG. 1 is a perspective view of a shower-bath arrangement in which bathtub rim water dams have been affixed to the upper rim of the bathtub.

The bathtub (12) consists of an outer side wall (20), two inner side walls (22) and (24), two inner end walls (26) and (28), and an upper rim (30).

Figure 2:
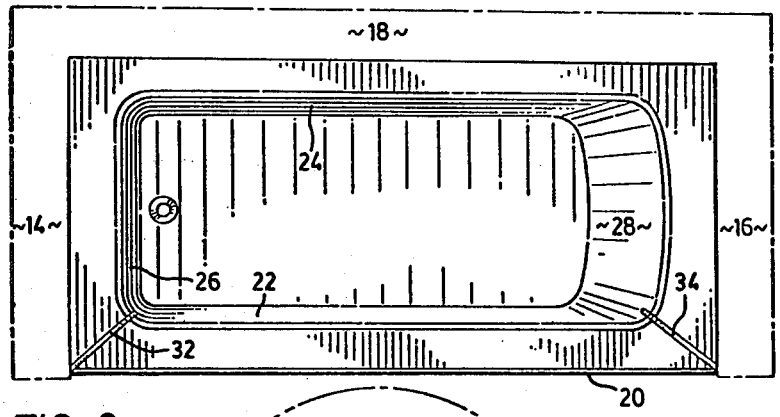
FIG. 2 is a top plan view of the shower-bath arrangement shown in FIG. 1.
Figure 3:
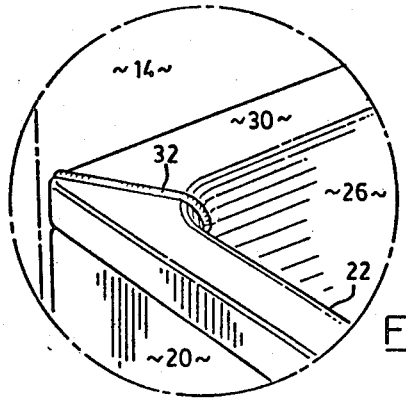
FIG. 3 is an enlarged perspective view of the bathtub rim water dam.

As best shown in FIGS. 2 and 3, strips of plastic (32) and (34) are affixed to the upper rim (30) of the bathtub (12) and extend diagonally across the upper rim (30) of the bathtub (12) from and in abutment with the end walls (14) and (16) of the stall across the upper rim (30) and down the inner side wall (22) of the bathtub (12) for a short distance.

While the plastic strips may be of virtually any cross section, it is preferred that a semi-circular cross section be used to present a flat surface to the rim and a rounded surface to a person entering or leaving the bathtub. As mentioned earlier it has been found that when heated at 150° C. (300° F.) for 2–3 minutes, plastic car trim having a self adhesive backing is well suited to this invention when the trim is appropriately cut. This product has a good water resistant adhesive that may be applied to a bathtub in a simple and conventional way.

When showering, water runs off the walls (14), (16) and (18) and collects on the upper rim (30) of the bathtub (12). The two semi-circular strips of plastic (32) and (34) acts as water dams and divert the flow of water about the upper rim (30) into the bathtub (12).

It will be appreciated by those skilled in the art that modifications to the preferred embodiment disclosed are possible and that other materials than plastic may be suitable for constructing the water dam of this invention.

The embodiments of the invention in which an exclusive property and privilege is claimed are as follows:

1. In a shower stall having a curtain extending between walls forming the stall, said stall having a receptacle in which a person may stand while showering, said receptacle having a rim capable of allowing water to run along its top surface between the walls and the curtain out of the shower stall, the improvement being a water dam comprising a strip adapted to be affixed to the top surface of the rim of the receptacle in abutment with a wall of the stall near an end of the curtain and further adapted to traverse the top surface of the rim and continue a short distance down into the receptacle.

2. The improvement of claim 1 in which the water dam is a strip of pliable material.

3. The improvement of claim 2 in which the water dam is a strip of plastic having a water resistant adhesive backing adapted to adhere to said receptacle rim

4. In a shower stall having front, side and back walls, a bathtub and a curtain extending between the front and back walls, said bathtub having an upper rim with a substantially flat top surface which will permit water to run along said top surface between the curtain and the front or back wall out of the shower stall, the improvement being a pair of water dams, each said dam comprising a strip of plastic having a water resistant adhesive backing, adapted to adhere to the bathtub, and each said strip being adapted to be affixed in abutment with one of the front and the back walls of the stall, near the respective ends of the curtain, across the rim and down inside the bathtub for a short distance, said dams being adapted to divert water running along the bathtub rim, back into the bathtub.

* * * * *